United States Patent [19]

Schwarz, II

[11] Patent Number: 4,553,286

[45] Date of Patent: Nov. 19, 1985

[54] HINGE PREPARATION ASSEMBLY FOR A STEEL DOOR FRAME

[75] Inventor: Ernest D. Schwarz, II, Cincinnati, Ohio

[73] Assignee: American Standard Inc., New York, N.Y.

[21] Appl. No.: 602,029

[22] Filed: Apr. 19, 1984

[51] Int. Cl.[4] ..... E05D 5/00

[52] U.S. Cl. ..... 16/382; 16/222; 16/254; 16/247; 16/DIG. 29

[58] Field of Search ..... 49/504; 16/382, 221, 16/352, 383, 384, DIG. 29, 247, DIG. 43, 222

[56] References Cited

U.S. PATENT DOCUMENTS

| | | | |
|---|---|---|---|
| 1,323,757 | 12/1919 | Gogay | 16/382 |
| 1,323,758 | 12/1919 | Gogay | 16/382 |
| 3,229,323 | 1/1966 | Hensgen | 16/247 |
| 3,274,735 | 9/1966 | Stackhouse | 49/504 |
| 4,034,514 | 7/1977 | Cecil | 49/504 |

OTHER PUBLICATIONS

"Nomenclature for Steel Doors and Steel Door Frames", ©1974.

*Primary Examiner*—Donald R. Schran
*Assistant Examiner*—James Wolfe
*Attorney, Agent, or Firm*—James J. Salerno, Jr.; Robert G. Crooks; John P. Sinnott

[57] ABSTRACT

The invention relates to hinge preparation assembly for mounting in each of the mortises formed in the hinge jamb of a steel frame. The hinge preparation assembly includes a hinge reinforcement member having a plurality of spaced apart threaded openings for mounting a leaf of a standard weight hinge set thereto. A hinge conversion means is removably mounted to the hinge reinforcement member so that upon its removal, the hinge preparation assembly is converted from a standard weight hinge preparation to a heavy weight hinge preparation and capable of mounting a leaf of a heavy weight hinge set thereto without requiring changing the hinge jamb of a steel door frame or modifying the hinge mortises thereof.

13 Claims, 9 Drawing Figures

HINGE PREPARATION ASSEMBLY FOR A STEEL DOOR FRAME

FIELD OF THE INVENTION

The present invention relates to a steel door frame assembly, and more particularly, to a steel door frame, having hinge preparation assemblies adapted to receive either standard or heavy weight hinge sets.

PRIOR ART

In the manufacture of steel door frames, the preparation of the hinge cutouts or mortises are made during the forming of the hinge jamb member. A hinge reinforcement member in the form of a plate or channel is generally spot-welded across each mortise of the hinge jamb. The reinforcement plate has threaded openings, which correspond to the openings in the leaf of the hinge set. Door hinge fillers are used as a small removable trim part located between the hinge leaf and door hinge reinforcements and is reversible to accommodate change of door handing. Also, frame plaster guards, generally in the form of a box, are mounted behind the hinge and strike reinforcements, to prevent mortar or plaster from filling the threaded mounting holes. Generally, steel frames are manufactured to accommodate only a standard weight hinge or only a heavy weight hinge. Therefore, steel frames, having standard weight and heavy weight hinge preparation assemblies are separately manufactured and stocked by suppliers. Such procedures add expense to their manufacture and increase inventories for the manufacturer as well as the supplier.

SUMMARY OF THE INVENTION

It is an object of the invention to provide a multiuse steel frame assembly, having a hinge conversion means adapted to mount a standard weight or a heavy weight hinge leaf without the necessity of changing or modifying the hinge mortises of the frame.

Another object of the invention is to provide a hinge guard plate to prevent flowable material from filling the threaded openings of the hinge reinforcement plate for a steel frame.

Another object of the invention is to provide means to rapidly convert the hinge preparation assembly of a steel frame from a standard weight hinge preparation to a heavy weight hinge preparation without requiring changing the steel frame or without modifying the hinge mortises of the steel frame.

A further object of the invention is to provide a hinge conversion means removably mounted on the hinge reinforcement plate of the steel frame for converting each hinge preparation assembly thereof from a standard weight to a heavy weight hinge preparation.

The invention generally contemplates providing a hinge preparation assembly capable of mounting a leaf of a heavy weight hinge set thereto without requiring changing the mortise preparation. The hinge preparation assembly comprises a hinge reinforcement member adapted to be mounted to each hinge cutout section of a steel member and having a plurality of spaced apart openings including spaced apart threaded openings corresponding to the openings of the hinge leaf. A hinge conversion means is mounted on the hinge reinforcement member and is formed having a thickness which is substantially equal to the difference between that of a standard weight hinge leaf and a heavy weight hinge leaf. The hinge conversion means is removably mounted to the hinge reinforcement member so that upon its removal, the hinge preparation assembly is converted from a standard weight hinge preparation to a heavy weight hinge preparation. Also, the hinge conversion means may include a guard plate, which is mounted to the hinge reinforcement member to prevent the threaded openings for mounting the hinge leaf thereon from being filled with flowable materials, such as plaster, cement or other solid flowable materials.

DETAILED DESCRIPTION OF THE PREFERRED EMBODIMENT

Figure 1:
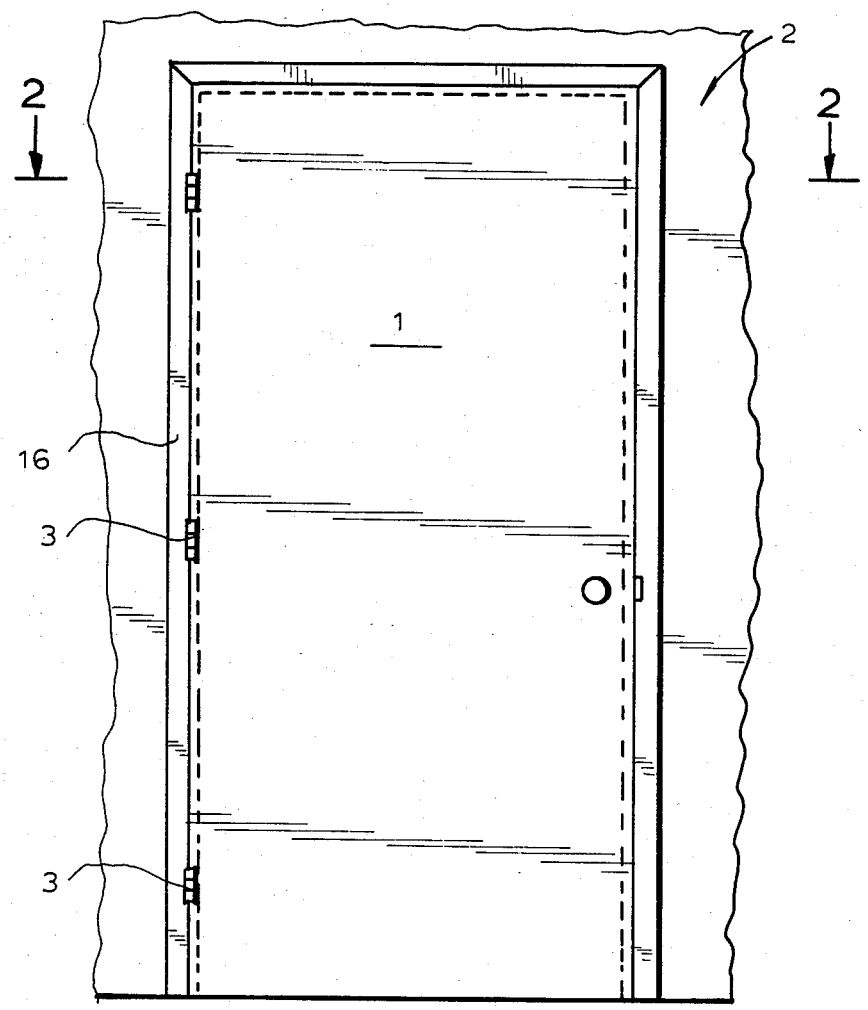
FIG. 1 is an elevational plan view of a steel door and steel frame made in accordance with the present invention.
Figure 2:
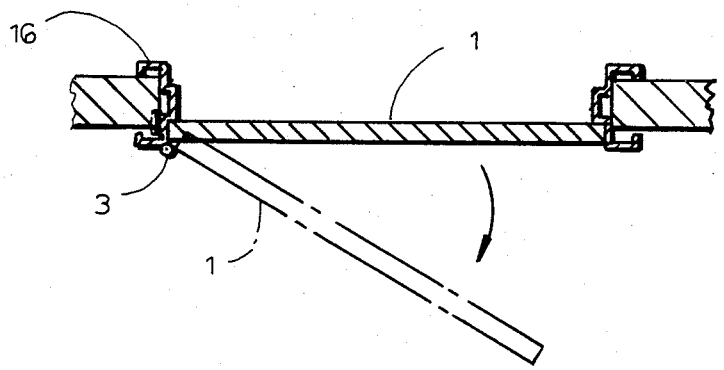
FIG. 2 is a sectional view taken along the line 2—2 of FIG. 1.
Figure 3:
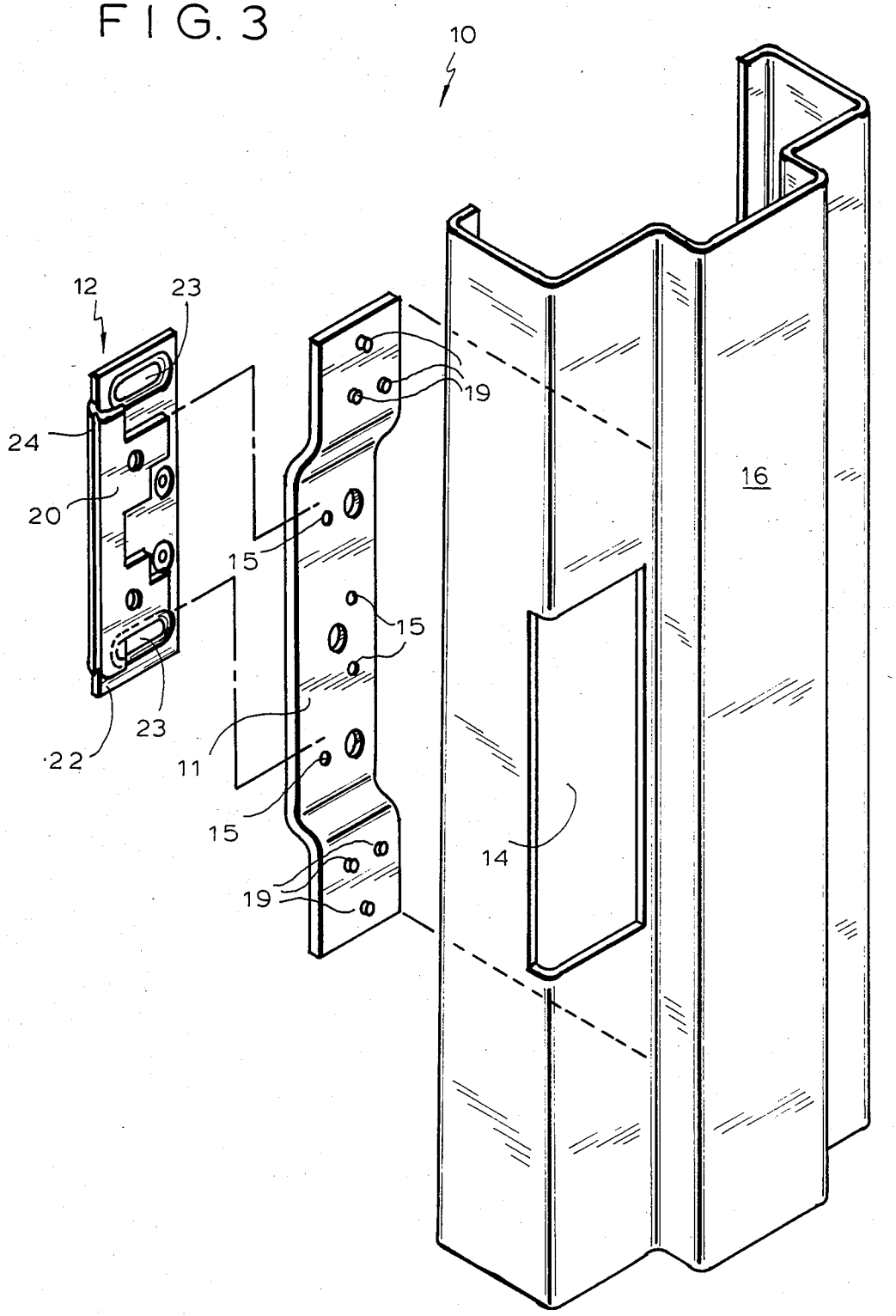
FIG. 3 is an exploded view, in perspective, of a section of the hinge jamb, showing the hinge preparation assembly including the hinge conversion means that is mounted to the hinge reinforcement plate of the hinge jamb.
Figure 6:
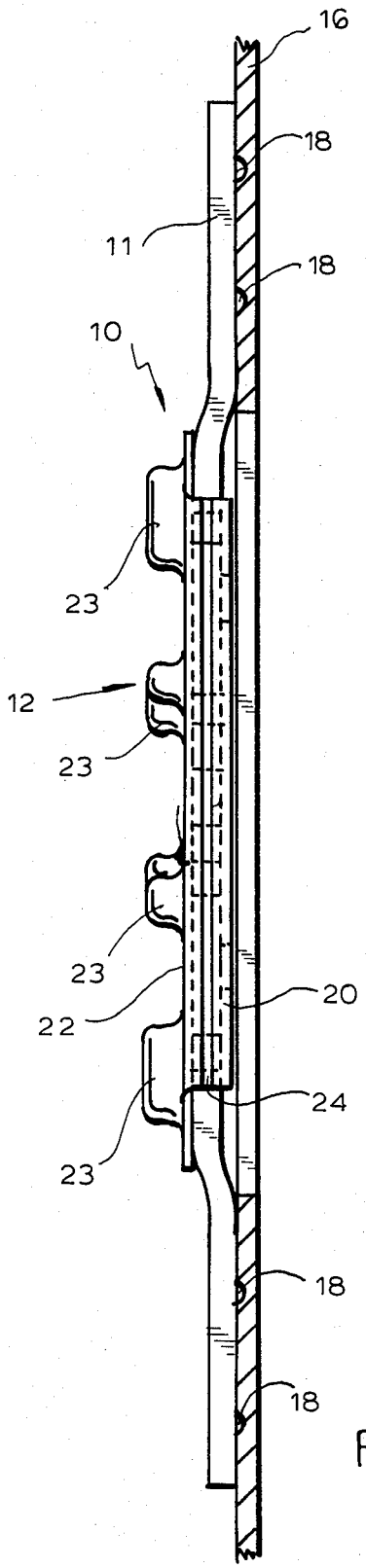
FIG. 6 is a sectional elevational view taken along line 6—6 of FIG. 5.
Figure 4:
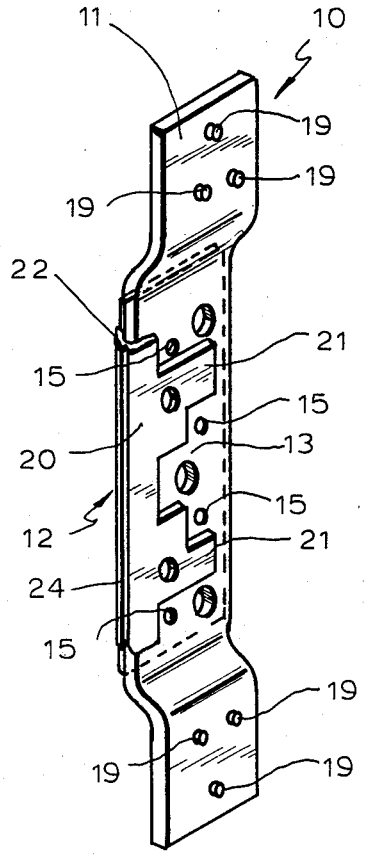
FIG. 4 is a perspective view of the hinge reinforcement plate and the hinge conversion means fully assembled and prior to its mounting to the hinge cut-out of the hinge jamb shown in FIG. 3.
Figure 5:
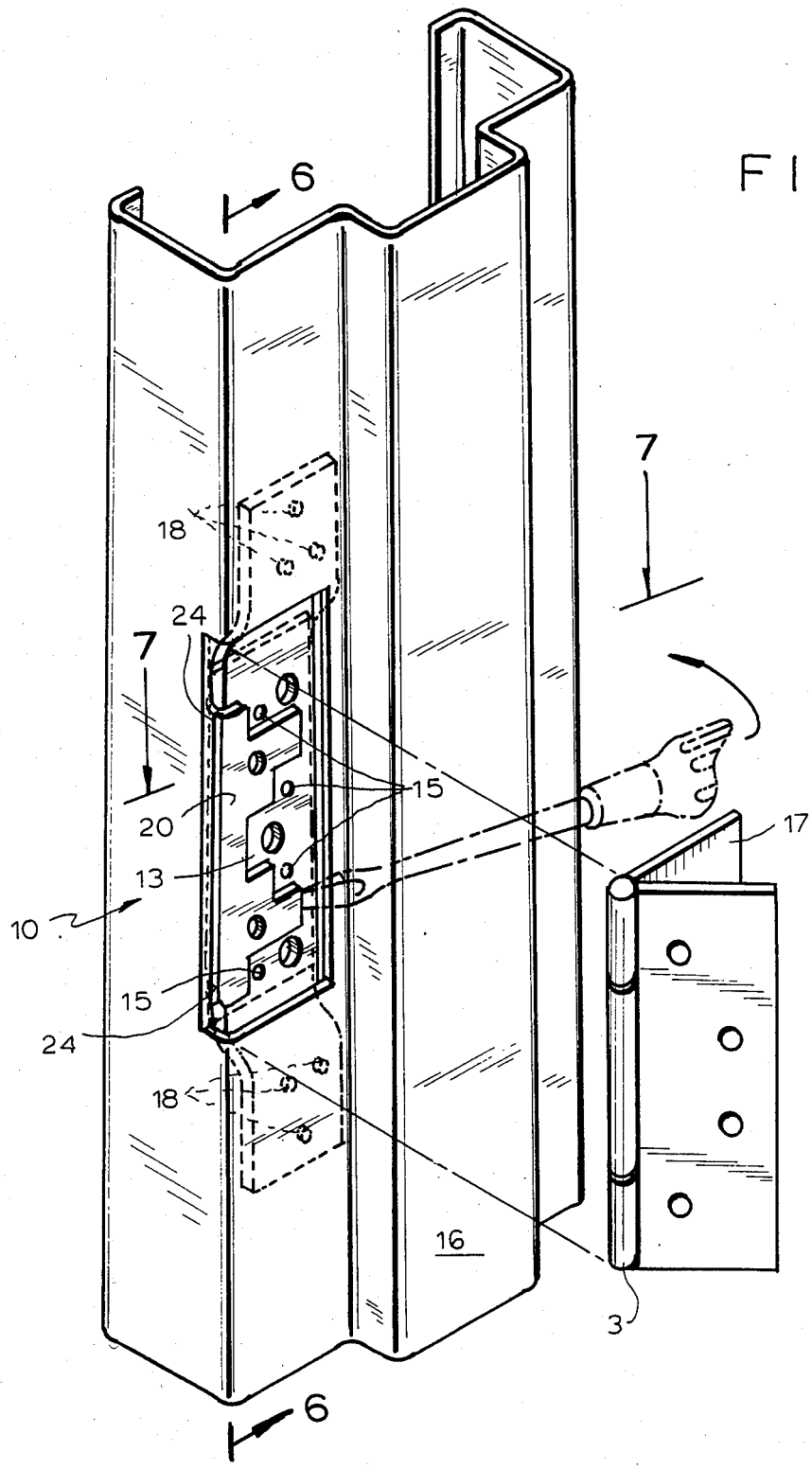
FIG. 5 is a perspective view of the hinge preparation assembly of FIG. 3 mounted on the hinge cutout of the hinge jamb and which depicts the removal of the hinge conversion means therefrom to convert the hinge preparation assembly from a standard weight hinge preparation to a heavy weight hinge preparation.
Figure 7:
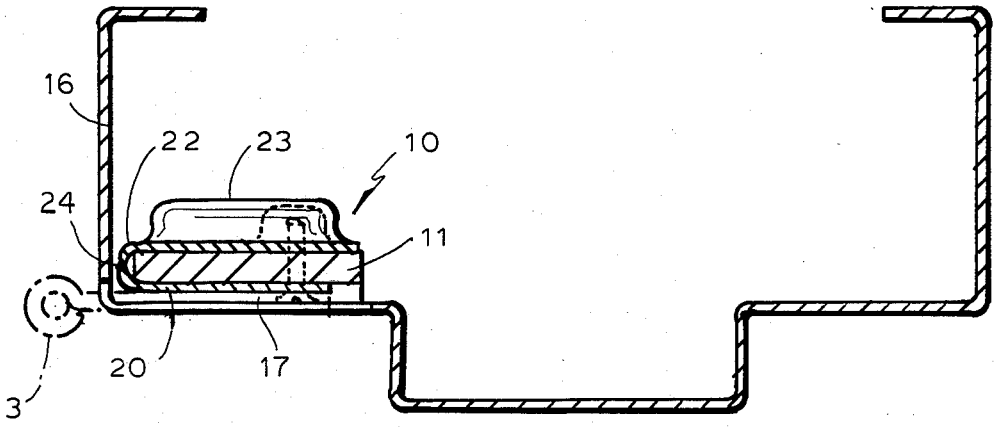
FIG. 7 is a sectional view of the hinge jamb taken along line 7—7 of FIG. 5, showing a standard weight hinge in dotted line mounted thereon.
Figure 8:
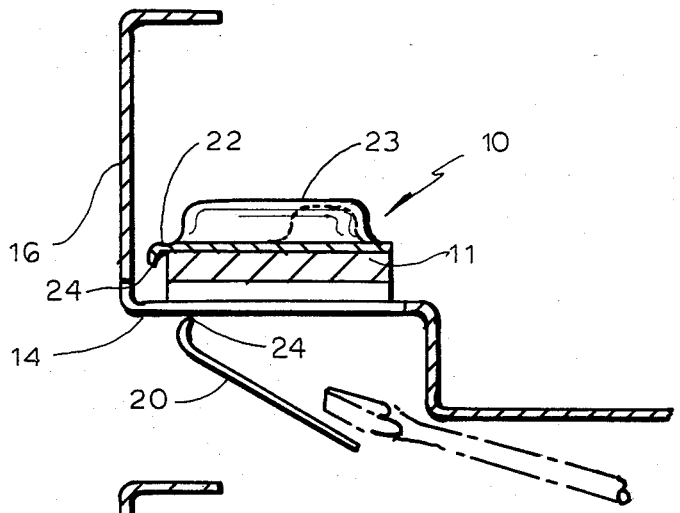
FIG. 8 is a fragmentary sectional view of FIG. 7, showing the removal of the hinge conversion means.
Figure 9:
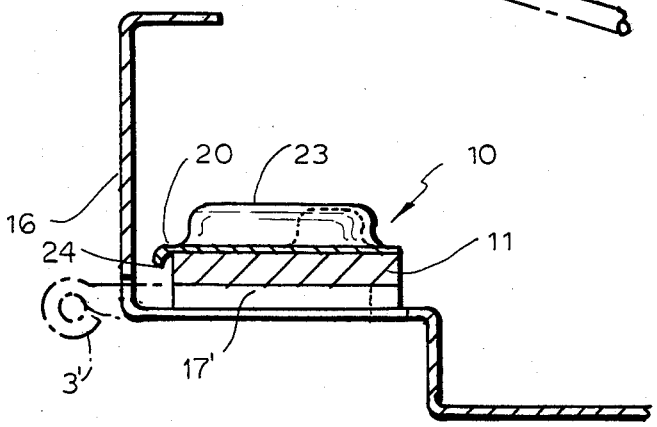
FIG. 9 is a fragmentary sectional view, similar to FIG. 7, showing a heavy weight hinge, in dotted line, mounted on the hinge jamb hinge reinforcement plate after removal of the hinge conversion means therefrom.

In the drawings, FIGS. 1–9 illustrate one form of a hinge conversion means 12 of hinge preparation assembly 10. Hinge preparation assembly 10 is shown mounted to the hinge cutout 14 of a steel door jamb 16. Hinge conversion means 12 is mounted to hinge reinforcement plate 11 as by spot welding at 13. Spot weld dimples 19 are formed on the reinforcement plate 11 to facilitate mounting hinge preparation assembly 10 to the hinge jamb 16 as by spot welding at 18, seen most clearly in FIG. 5. Hinge reinforcement plate 11 is formed having spaced threaded openings 15, which correspond to openings in hinge leaf or plate 17. Hinge conversion means 12 is formed from a unitary steel sheet and is bent in the form of a "U" to provide a slip fit on hinge reinforcement plate 11, shown most clearly in FIGS. 3–5. The lower plate 22 is formed, having a plurality of bubbles 23, which are aligned to cover threaded openings 15. The upper plate 20 is formed, having a plurality of fingers 21, which fit between threaded openings 15. Upper plate 20 is separable from lower plate 22 by longitudinally extending groove 24. As seen in FIG. 7, hinge 3 is mounted to hinge preparation assembly 10 which, in turn, is mounted on steel hinge jamb 16 by spot welds 19. Hinge 3 is a standard weight hinge so that the upper surface of hinge leaf 17, together with upper plate 20 of hinge conversion means 12, is equal to the thickness of the depth of the mortise 14 so that the upper surface of hinge leaf 17 lies in the same plane as the outer surface of the hinge jamb 16. In FIG. 8, a screwdriver is depicted in dot-dash lines to show that upper plate 20 of hinge conversion means 12 is separated from hinge reinforcement member 11 and breaks along longitudinally extending groove 24. Lower plate 22 remains mounted behind reinforcement plate 11. In FIG. 9, after upper plate 20 has been removed, heavy weight hinge 17' of hinge 3' is mounted on hinge reinforcement plate 11 and is equal to the thickness of the depth of the mortise 14. Lower plate 23 may be used. with a hinge preparation assembly of a steel door when flowable materials are used to fill the door. The relative size of the hinge preparation assembly design and depth of mortise preparations may vary without departing from the invention herein. Also hinge conversion means 12, while illustrated as being made of metal, it is obvious that a suitably formed plastic material may be used and that lower plate or guard 22 may be adhesively mounted to reinforcement plate 11.

It is claimed:

1. A hinge preparation assembly capable of mounting a leaf of a standard weight hinge set or a heavy weight hinge set thereto without requiring changing the depth of each cutout section of a steel member, said hinge preparation assembly comprising:

a hinge reinforcement member mounted to said each hinge cutout section of said steel member, said each cutout section having a depth equal to the thickness of a heavy weight hinge leaf, said hinge reinforcement member having a plurality of spaced apart openings, including spaced apart threaded openings corresponding to the openings of said hinge leaf;

a hinge conversion means, formed in the shape of a unitary member, is mounted to said hinge reinforcement member and has a thickness which is substantially equal to the difference between that of the standard weight hinge leaf and the heavy weight hinge leaf; and said unitary member including frangible means so that upon its removal from said hinge reinforcement member, said hinge preparation assembly converts from a standard weight hinge leaf preparation to that of a heavy weight hinge leaf preparation.

2. The hinge preparation assembly of claim 1, wherein said steel member is a steel hinge jamb for a door frame.

3. The hinge preparation assembly of claim 1, wherein said hinge conversion means is a generally flat rectangular plate and is formed having at least a pair of spaced apart arms shaped to nest adjacent said threaded openings in said reinforcement member.

4. The hinge preparation assembly in accordance with claim 1, wherein said hinge conversion means is a generally U-shaped, unitary member and is positioned in mating contact on said reinforcement member and includes an upper plate with a thickness equal to the difference in thickness between that of a heavy weight hinge leaf and a standard weight hinge leaf and a lower plate mounted to said hinge reinforcement member, said upper plate being separable from said lower plate by a longitudinally extending zone of weakening formed between said upper and lower plates.

5. The hinge conversion means in accordance with claim 4, wherein said upper plate is formed having a pair of spaced apart arms extending perpendicular from said zone of weakening and each of said arms being disposed adjacent to said spaced apart threaded openings of said reinforcement member.

6. The hinge conversion means in accordance with claim 4, wherein said lower plate is welded to said hinge reinforcement member and includes a plurality of spaced bubbles which are positioned to cover said threaded openings in said reinforcement member to prevent a flowable solid material from filling or covering said threaded openings.

7. A steel door frame comprising:

a strike jamb, a hinge jamb and a header for coupling said strike and hinge jamb in spaced apart relation, said hinge jamb having a plurality of vertically spaced and aligned hinge cutout sections whose depth is equal to the thickness of a heavy weight hinge leaf, and a hinge preparation assembly mounted across each cutout section;

said hinge preparation assembly including a hinge reinforcement member, said hinge reinforcement member having a plurality of spaced apart openings including spaced apart threaded openings, which correspond to the spaced openings in a leaf of a standard weight hinge set or a leaf of a heavy weight hinge set; and a hinge conversion means, formed in the shape of a unitary member, is mounted to said hinge reinforcement member and has a thickness substantially equal to the difference between that of a standard weight hinge leaf and a heavy weight hinge leaf, said unitary member including frangible means so that upon its removal, the hinge preparation assembly converts from a standard weight hinge leaf preparation to that of a heavy weight hinge leaf preparation without requiring changing said hinge jamb or modifying said hinge cutout sections.

8. The steel door frame of claim 7, wherein said conversion means is generally a flat rectangular plate and has at least a pair of spaced apart arms shaped to nest adjacent said threaded openings in said reinforcement member.

9. The steel door frame in accordance with claim 7, wherein said hinge conversion means is generally a U-shaped, unitary member and is positioned in mating contact on said hinge reinforcement member and includes an upper plate with a thickness equal to the thickness between that of a heavy weight hinge leaf and a standard weight hinge leaf and having a lower plate mounted to said hinge reinforcement member, said upper plate being separable from said lower plate by a longitudinally extending zone of weakening formed between said upper and lower plates.

10. The steel door frame in accordance with claim 9, wherein said upper plate is formed having a pair of spaced apart arms extending perpendicular from said zone of weakening and each of said arms being disposed adjacent to said spaced apart threaded openings of said reinforcement member.

11. The steel door frame in accordance with claim 9, wherein said lower plate is welded to said hinge reinforcement member and includes a plurality of spaced bubbles which are positioned to cover said threaded openings in said reinforcement member to prevent a flowable solid material from filling or covering said threaded openings.

12. A hinge conversion means adapted to be mounting to a hinge reinforcement member to form a hinge preparation assembly and which is capable of mounting a leaf of a heavy weight hinge set or a leaf of a standard weight hinge set without requiring the changing of the depth of the hinge cutout opening of a steel member comprising:

a generally flat, U-shaped, unitary member capable of being positioned in mating contact on said hinge reinforcement member, said U-shaped member having a lower plate adapted to be mounted to said hinge reinforcement member and an upper plate;

said upper plate having a thickness which is substantially equal to the difference in thickness between that of a standard weight hinge leaf and a heavy weight hinge leaf; and said upper plate being separable from said lower plate by a longitudinally extending zone of weakening formed between said upper and lower plates.

13. The hinge conversion means in accordance with claim 12, wherein said lower plate includes a plurality of spaced bubbles which are positioned to cover corresponding threaded openings in said reinforcement member to prevent a flowable solid material from filling or covering said threaded openings.

* * * * *